US011196172B2

(12) United States Patent
Xi et al.

(10) Patent No.: US 11,196,172 B2
(45) Date of Patent: Dec. 7, 2021

(54) PHASED-ARRAY ANTENNA AND METHOD FOR CONTROLLING THE SAME

(71) Applicants: Shanghai Tianma Micro-Electronics Co., Ltd., Shanghai (CN); Chengdu Tianma Micro-Electronics Co., Ltd., Sichuan (CN)

(72) Inventors: Kerui Xi, Shanghai (CN); Tingting Cui, Shanghai (CN); Zhenyu Jia, Shanghai (CN); Feng Qin, Shanghai (CN); Xuhui Peng, Shanghai (CN); Zuocai Yang, Sichuan (CN)

(73) Assignees: SHANGHAI TIANMA MICRO-ELECTRONICS CO., LTD., Shanghai (CN); CHENGDU TIANMA MICRO-ELECTRONICS CO., LTD., Sichuan (CN)

( * ) Notice: Subject to any disclaimer, the term of this patent is extended or adjusted under 35 U.S.C. 154(b) by 0 days.

(21) Appl. No.: 16/917,667

(22) Filed: Jun. 30, 2020

(65) Prior Publication Data

US 2021/0328355 A1 Oct. 21, 2021

(30) Foreign Application Priority Data

Apr. 15, 2020 (CN) ..... 202010294209.9

(51) Int. Cl.
*H01Q 9/04* (2006.01)
*H01Q 21/00* (2006.01)
(Continued)

(52) U.S. Cl.
CPC ..... *H01Q 13/206* (2013.01); *H01Q 3/34* (2013.01); *H01Q 5/335* (2015.01); *H01Q 5/357* (2015.01)

(58) Field of Classification Search
CPC .. H01Q 21/0006; H01Q 21/065; H01Q 21/06; H01Q 21/00; H01Q 9/04;
(Continued)

(56) References Cited

U.S. PATENT DOCUMENTS 4,035,807 A * 7/1977 Tang ..... H01Q 3/38 343/742
5,043,738 A * 8/1991 Shapiro ..... H01Q 5/385 343/700 MS
(Continued)

FOREIGN PATENT DOCUMENTS

CN 107658547 A 2/2018
CN 108808181 A 11/2018
CN 110649356 A 1/2020

*Primary Examiner* — Tho G Phan
(74) *Attorney, Agent, or Firm* — Alston & Bird LLP

(57) ABSTRACT

A phased-array antenna and a method for controlling the same are provided. The phased-array antenna includes first and second substrates between which a cavity is formed. Phase-shifting units in the cavity each includes: a power feeder located on a surface of the first substrate facing away from the second substrate and connected to a radio-frequency signal terminal, a radiator located on the surface and insulated from the power feeder, a ground electrode located on a surface of the first substrate facing towards the second substrate. The ground electrode connects to the ground signal terminal and overlaps with the power feeder and the radiator and includes a first and a second openings. A transmission electrode located on a surface of the second substrate facing the first substrate and connects to the control signal line.

22 Claims, 10 Drawing Sheets

(51) Int. Cl.

| | |
|---|---|
| ***H01Q 21/06*** | (2006.01) |
| ***H01Q 13/20*** | (2006.01) |
| ***H01Q 5/357*** | (2015.01) |
| ***H01Q 5/335*** | (2015.01) |
| ***H01Q 3/34*** | (2006.01) |

(58) Field of Classification Search
CPC ..... H01Q 9/045; H01Q 9/16; H01Q 1/38; H01Q 13/206; H01Q 13/20; H01Q 5/335; H01Q 5/33; H01Q 5/357; H01Q 5/35; H01Q 5/34
See application file for complete search history.

(56) References Cited

U.S. PATENT DOCUMENTS

| | | | | |
|---|---|---|---|---|
| 6,184,832 | B1 * | 2/2001 | Geyh | H01Q 1/02 343/700 MS |
| 10,141,620 | B2 * | 11/2018 | Jakoby | H01P 1/184 |
| 10,826,192 | B2 * | 11/2020 | Ting | H01Q 1/44 |
| 10,903,568 | B2 * | 1/2021 | Bulja | H01Q 3/30 |
| 2020/0243969 | A1 * | 7/2020 | Fang | H01P 1/184 |

* cited by examiner

PHASED-ARRAY ANTENNA AND METHOD FOR CONTROLLING THE SAME

CROSS-REFERENCE TO RELATED APPLICATIONS

The present application claims priority to Chinese Patent Application No. CN202010294209.9, filed on Apr. 15, 2020, the content of which is incorporated herein by reference in its entirety.

TECHNICAL FIELD

The present disclosure relates to the technical field of electromagnetic waves, and in particular, to a phased-array antenna and a method for controlling the same.

BACKGROUND

With gradual evolution of communication systems, the phased-array antenna has been widely used. In the related art, the phased-array antenna includes antenna units, and each of the antenna units is configured to shift phases of radio-frequency signals and then radiate the radio-frequency signals. The radio frequency signals radiated by the antenna units interfere with each other to form a beam having a main lobe direction. In the related art, the phase shifter is a fixed phase-shifting device, thus, if each antenna unit includes only one phase shifter, one antenna unit can only radiate a radio-frequency signal having only one phase. In this case, after the radio-frequency signals radiated by the antenna units interfere with each other, the antenna can only form a beam having a specific main lobe direction, which cannot be adjusted. Therefore, each antenna unit usually includes multiple phase shifters, and different phase shifters are selected through an electronic switch to obtain different phases, so that the radio-frequency signals radiated by the antenna unit have different phases. In this way, the main lobe direction of the phased-array antenna can be adjusted.

However, as a result, a large number of phase shifters are provided in the phased-array antenna, causing high cost and high power consumption of the phased-array antenna. In particular, with the advent of the 5G and even 6G era, the demand for providing phased-array antennas is increasing in fields of mobile stations, in-vehicles, and low-orbit satellite communication systems. Therefore, it is an urgent technical problem to be solved to reduce the manufacturing cost of the phased-array antennas.

SUMMARY

The embodiments of the present disclosure provide a phased-array antenna and a method for controlling the same, which can decrease the number of phase shifters of the phased-array antenna and decrease cost of the phased-array antenna.

In an aspect, an embodiment of the present disclosure provides a phased-array antenna, the phased-array antenna includes a first substrate, a second substrate opposite to the first substrate, and a plurality of phase-shifting units received in a cavity formed between a part of the first substrate and a part of the second substrate that face towards each other. Each of the plurality of phase-shifting units includes a power feeder, a radiator, a ground electrode, a transmission electrode, and liquid crystal molecules. The power feeder is located on a surface of the first substrate facing away from the second substrate and electrically connected to a radio-frequency signal terminal. The radiator is located on the surface of the first substrate facing away from the second substrate and electrically insulated from the power feeder. The ground electrode is located on a surface of the first substrate facing towards the second substrate, is electrically connected to a ground signal terminal, and overlaps with the power feeder and the radiator in a direction perpendicular to a plane of the first substrate. The ground electrode include a first opening and a second opening, the first opening is located at an area of the ground electrode where the ground electrode overlaps with the power feeder, and the second opening is positioned at an area of the ground electrode where the ground electrode overlaps with the radiator. The transmission electrode is located on a surface of the second substrate facing towards the first substrate, is electrically connected to a control signal line, and overlaps with the power feeder, and the radiator and the ground electrode in the direction perpendicular to the plane of the first substrate. The transmission electrode covers the first opening and the second opening in a direction perpendicular to a plane of second substrate. The liquid crystal molecules are located between the first substrate and the second substrate.

In another aspect, an embodiment of the present disclosure provides a method for controlling the phased-array antenna described above. The method, for each of the plurality of phase-shifting units, includes: providing, by the radio-frequency signal terminal, a radio-frequency signal to the power feeder of the phase-shifting unit, providing, by the ground signal terminal, a ground signal to the ground electrode of the phase-shifting unit, and providing, by one of the plurality of control signal lines, a control signal to the transmission electrode of the phase-shifting unit; coupling the radio-frequency signal transmitted in the power feeder to the transmission electrode through the first opening of the ground electrode; deflecting the liquid crystal molecules of the phase-shifting unit by an electric field formed by the transmission electrode and the ground electrode, in such a manner that a dielectric constant of the liquid crystal molecules is changed to shift a phase of a radio-frequency signal transmitted in the transmission electrode; and coupling the radio-frequency signal having the phase shifted to the radiator through the second opening of the ground electrode, and radiating the radio-frequency signal through the radiator of the phase-shifting unit. Radio-frequency signals radiated by the plurality of phase-shifting units interfere with each other to form the beam having the main lobe direction.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, and other drawings can also be acquired by those skilled in the art without paying creative efforts.

DESCRIPTION OF EMBODIMENTS

For better illustrating technical solutions of the present disclosure, embodiments of the present disclosure will be described in detail as follows with reference to the accompanying drawings.

It should be noted that, the described embodiments are merely exemplary embodiments of the present disclosure, which shall not be interpreted as limitations to the present disclosure. All other embodiments obtained by those skilled in the art without creative efforts according to the embodiments of the present disclosure fall into the scope of the present disclosure.

The terms used in the embodiments of the present disclosure are merely for the purpose of describing particular embodiments but not intended to limit the present disclosure. Unless otherwise noted in the context, the expressions in singular forms "a", "an", "the" and "said" used in the embodiments and appended claims of the present disclosure are also intended to represent expressions in plural forms thereof.

It should be understood that the term "and/or" used herein is merely an association describing associated objects, indicating that there can be three relationships, for example, "A and/or B" can include three cases, i.e., only A, A and B, and only B. In addition, the character "/" herein generally indicates that the associated objects form an "or" relationship therebetween.

It should be understood that, although the substrate, the opening and the phase-shifting region can be described using the terms of "first", "second", etc., in the embodiments of the present disclosure, the substrate, the opening and the phase-shifting region will not be limited to these terms. These terms are merely used to distinguish substrates from one another, distinguish openings from one another and distinguish phase-shifting regions from one another. For example, without departing from the scope of the embodiments of the present disclosure, a first substrate can also be referred to as a second substrate; similarly, a second substrate can also be referred to as a first a first substrate.

Figure 1:
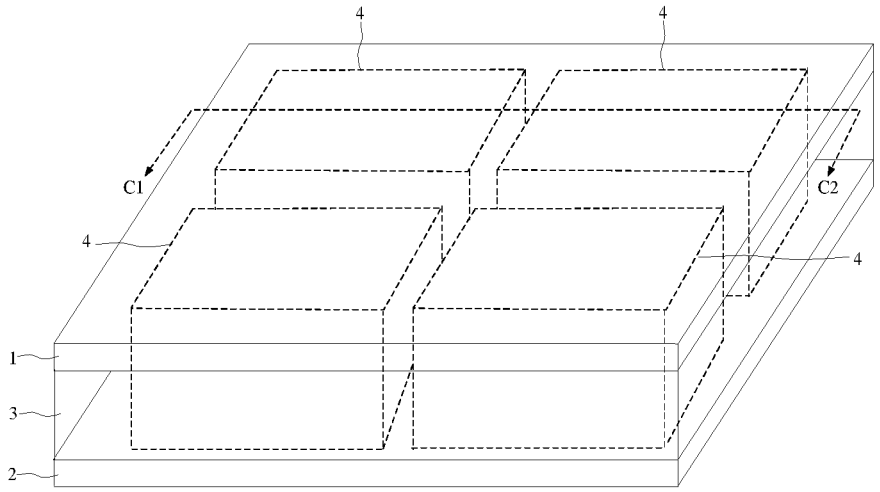
FIG. 1 is a schematic diagram of a phased-array antenna according to an embodiment of the present disclosure.
Figure 2:
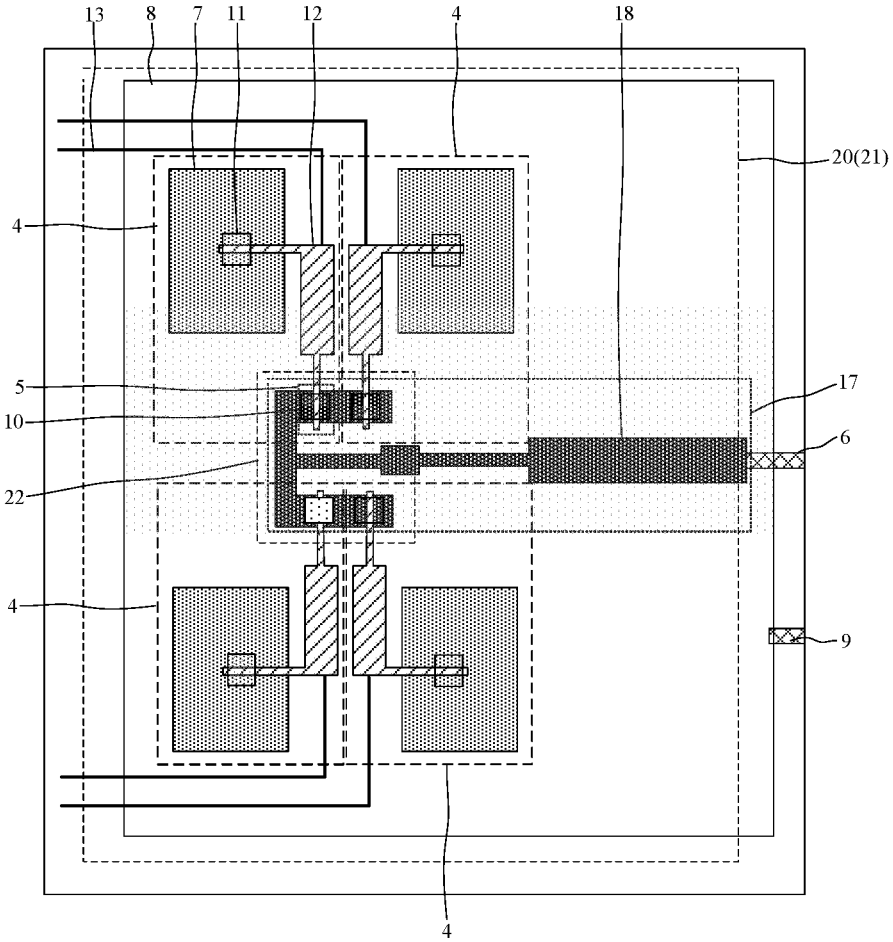
FIG. 2 is a top view of a phased-array antenna according to an embodiment of the present disclosure.
Figure 3:
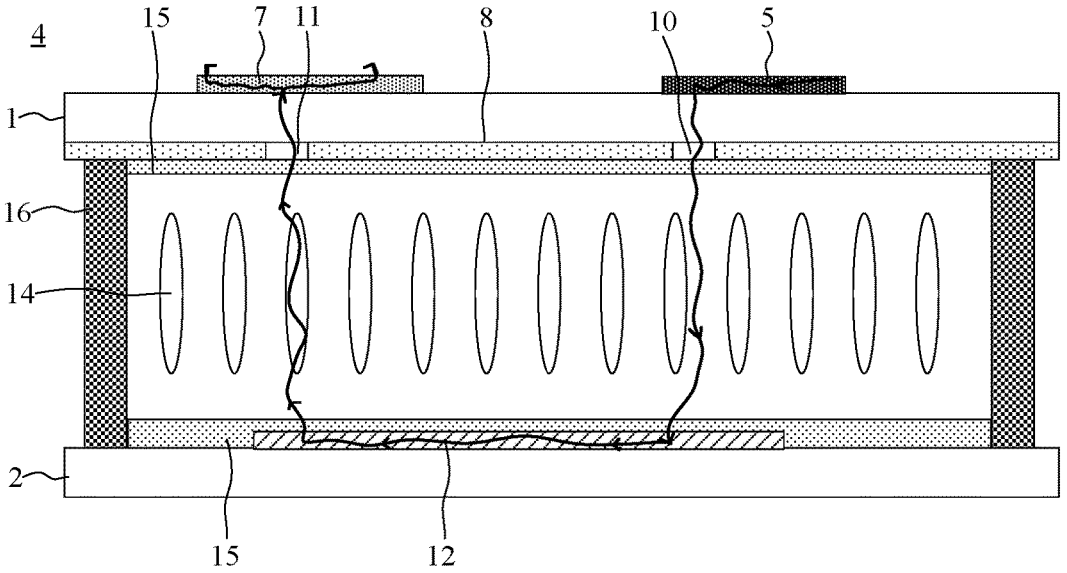
FIG. 3 is a schematic diagram of a single phase-shifting unit according to an embodiment of the present disclosure.

An embodiment of the present disclosure provides a phased-array antenna. FIG. 1 is a schematic diagram of a phased-array antenna according to an embodiment of the present disclosure, FIG. 2 is a top view of a phased-array antenna according to an embodiment of the present disclosure, and FIG. 3 is a schematic diagram of a single phase-shifting unit according to an embodiment of the present disclosure. As shown in FIG. 1 to FIG. 3, the phased-array antenna includes a first substrate 1 and a second substrate 2 that are opposite to each other, and multiple phase-shifting units 4. A cavity 3 is formed between the part of the first substrate 1 and the part the second substrate 2 that face towards each other, and receives the shifting elements 4. Each of the first substrate 1 and the second substrate 2 can be a glass substrate, a polyimide (PI) substrate, or a liquid crystal molecule polymer (LCP) substrate.

Each phase-shifting unit 4 includes a power feeder 5, a radiator 7, a ground electrode 8, a transmission electrode 8, and liquid crystal molecules 14. The power feeder 5 is located on a surface of the first substrate 1 facing away from the second substrate 2 and is electrically connected to a radio-frequency signal terminal 6. The radiator 7 is located on the surface of the first substrate 1 facing away from the second substrate 2 and is electrically insulated from the power feeder 5, that is, there is a gap formed between the radiator 7 and the power feeder 5. The ground electrode 8 is located on a surface of the first substrate 1 facing towards the second substrate 2 and is electrically connected to a ground signal terminal 9. The ground electrode 8 overlaps with the power feeder 5 and the radiator 7 in a direction perpendicular to a plane of first substrate 1. The ground electrode 8 includes a first opening 10 and a second opening 11, the first opening 10 is located at an area of the ground electrode 8 where the ground electrode 8 overlaps with the power feeder 5, and the second opening 11 is located at an area of the ground electrode 8 where the ground electrode 8 overlaps with the radiator 7. The transmission electrode 12 is located on a surface of the second substrate 2 facing towards the first substrate 1, and is electrically connected to a control signal line 13. The transmission electrode 12 overlaps with the power feeder 5, the radiator 7 and the ground electrode 8 in the direction perpendicular to the plane of first substrate 1. The transmission electrode 12 covers the first opening 10 and the second opening 11 in a direction perpendicular to a plane of second substrate 2. The liquid crystal molecules 14 are located between the first substrate 1 and the second substrate 2.

In an embodiment, alignment films 15 are respectively provided at a side of the first substrate 1 facing towards the second substrate 2 and a side of the second substrate 2 facing towards the first substrate 1, thereby driving the liquid crystal molecules 14 to deflect normally.

When controlling the phased-array antenna to radiate a beam, the radio-frequency signal terminal 6 provides a radio-frequency signal to the power feeder 5 of each phase-shifting unit 4, the ground signal terminal 9 provides a ground signal to the ground electrode 8 of each phase-shifting unit 4, and the control signal line 13 provides a control signal to the transmission electrode 12 of each phase-shifting unit 4; the radio-frequency signal transmitted in the power feeder 5 is coupled to the transmission electrode 12 through the first opening 10 of the ground electrode 8; the liquid crystal molecules 14 of the phase-shifting unit 4 deflects by an electric field formed between the transmission electrode 12 and the ground electrode 8, causing a dielectric constant of the liquid crystal molecules 14 to change, thereby shifting a phase of the radio-frequency signal transmitted in the transmission electrode 12; the radio-frequency signal having the phase shifted is coupled to the radiator 7 through the second opening 11 of the ground electrode 8, and is then radiated out via the radiator 7 of the phase-shifting unit 4 (a transmission path of the radio-frequency signal is shown by arrows in FIG. 3); and multiple radio-frequency signals radiated by multiple phase-shifting units 4 interfere with each other to form a beam having a main lobe direction.

For a single phase-shifting unit 4, the control signal line 13 provides different control signals to the transmission electrode 12, and the electric field formed by the transmission electrode 12 and the ground electrode 8 drives the liquid crystal molecules 14 to deflect, so that the liquid crystal molecules 14 can have different dielectric constants. Therefore, the phase-shifting unit 4 shifts the phase of the radio-frequency signal to different degrees. That is, in this embodiment of the present disclosure, the phase-shifting unit 4 is a phase-shifting unit 4 with a control signal having a variable voltage, and one phase-shifting unit 4 can radiate radio-frequency signals with multiple phases. In this way, by adjusting the phase of the radio-frequency signal radiated by the phase-shifting unit 4, when the radio-frequency signals radiated by the multiple phase-shifting units 4 interfere with each other, the resulting main lobe direction of the beam can be adjusted.

It can be seen that with the phased-array antenna provided by the embodiment of the present disclosure, each phase-shifting unit 4 can radiate radiation signals having different phases under different control signals, thereby adjusting the finally formed main lobe direction of the beam formed by the phased-array antenna. Compared with the related art, the number of phase-shifting units 4 of the phased-array antenna is greatly decreased, that is, the number of phase shifters is greatly decreased, thereby effectively reducing manufacturing cost of the phased-array antenna. In addition, the phased-array antenna provided by the embodiment of the present disclosure shifts the phase of the radio-frequency signal by the deflection of the liquid crystal molecule 14, and due to a high manufacturing capacity of a liquid crystal molecule panel, the manufacturing cost of the phased-array antenna can be further decreased.

In addition, the phase shifter in related art is a fixed phase-shifting device, and each phase shifter can radiate a radio-frequency signal having only one phase, when multiple antenna units select a certain phase shifter through an electronic switch to perform phase shifting, formation of the main lobe direction of the beam is discontinuous. For example, when the antenna unit includes a limited number of phase shifters, if the main lobe direction of the beam of the phased-array antenna needs to be adjusted within a range from 10° to 50°, the main lobe direction of the beam however can only be adjusted to be 10°, 30° or 50° by the antenna unit through switching different phase shifters. However, with the phased-array antenna provided by this embodiment of the present disclosure, an angle of the phase of the radio-frequency signal, which is shifted by the phase-shifting unit 4, is controlled by the control signal, and the control signal can be adjusted to be any value. Therefore, a single phase-shifting unit 4 can shift the phase of the radio-frequency signal to any degree, and finally the main lobe direction of the beam formed by the phased-array antenna can be adjusted to any direction corresponding to an angle ranging from 10° to 50°. That is, changing of the main lobe direction of the beam formed by the phased-array antenna can be continuous.

In addition, in the embodiment of the present disclosure, the electric field is formed between the transmission electrode 12 and the ground electrode 8 to drive the liquid crystal molecules 14 to deflect, thereby shifting the phase of the radio-frequency signal. There is a strong electric field formed in an area where a part of the transmission electrode 12 and a part of the ground electrode 8 face towards each other, so the liquid crystal molecules 14 in the area where the transmission electrode 12 is located has good deflection uniformity. Based on the structure of the phase-shifting unit 4 provided in the embodiment of the present disclosure, the phase of the radio-frequency signal is shifted when the radio-frequency signal is transmitted in the transmission electrode 12. Therefore, the liquid crystal molecules 14 in the area where the transmission electrode 12 is located can more accurately shift the phase of the radio-frequency signal being transmitted in the transmission electrode 12, thereby increasing a phase accuracy of the radio-frequency signal finally radiated out.

In addition, in the embodiment of the present disclosure, the ground electrode 8 and the radiator 7 are located at two sides of the first substrate 1. In the direction perpendicular to the plane of the first substrate 1, an orthographic projection of the radiator 7 is covered by an orthographic projection of the ground electrode 8, so a radiation effect of the radiator 7 on the radio-frequency signal can be enhanced. Moreover, when a part of radio-frequency signal radiated by the radiator 7 is transmitted to the second substrate 2, the ground electrode 8 can reflect back this part of signals, so that this part of signals is radiated toward the first substrate 1. In this way, signal loss is decreased.

It should also be noted that the radiator 7 of the phase-shifting unit 4 can both radiate and receive signals. When the radiator 7 receives the radio-frequency signal, the liquid crystal molecules 14 in the phase-shifting unit 4 control the phase of radio-frequency signal to be shifted. Then the radio-frequency signal, whose phase has been shifted, is transmitted to the radio-frequency signal terminal 6 through the power feeder 5, and is then radiated out via the radio-frequency signal terminal 6.

In an embodiment, with further reference to FIG. 2, the phased-array antenna includes a feed electrode 17, and the feed electrode 17 includes a feeder 18 and multiple power feeders 5. The multiple power feeders 5 correspond to the multiple phase-shifting units 4, and the multiple power feeders 5 are electrically connected to the radio-frequency signal terminal 6 through the feeder 18. In this way, the radio-frequency signal provided by the radio-frequency signal terminal 6 is transmitted to the power feeder 5 of each phase-shifting unit 4 through the feeder 18, thereby achieving normal operation of each phase-shifting unit 4. Moreover, with this configuration, only one radio-frequency signal terminal 6 needs to be provided for the phased-array antenna, which further decreases the manufacturing cost of the phased-array antenna.

Figure 4:
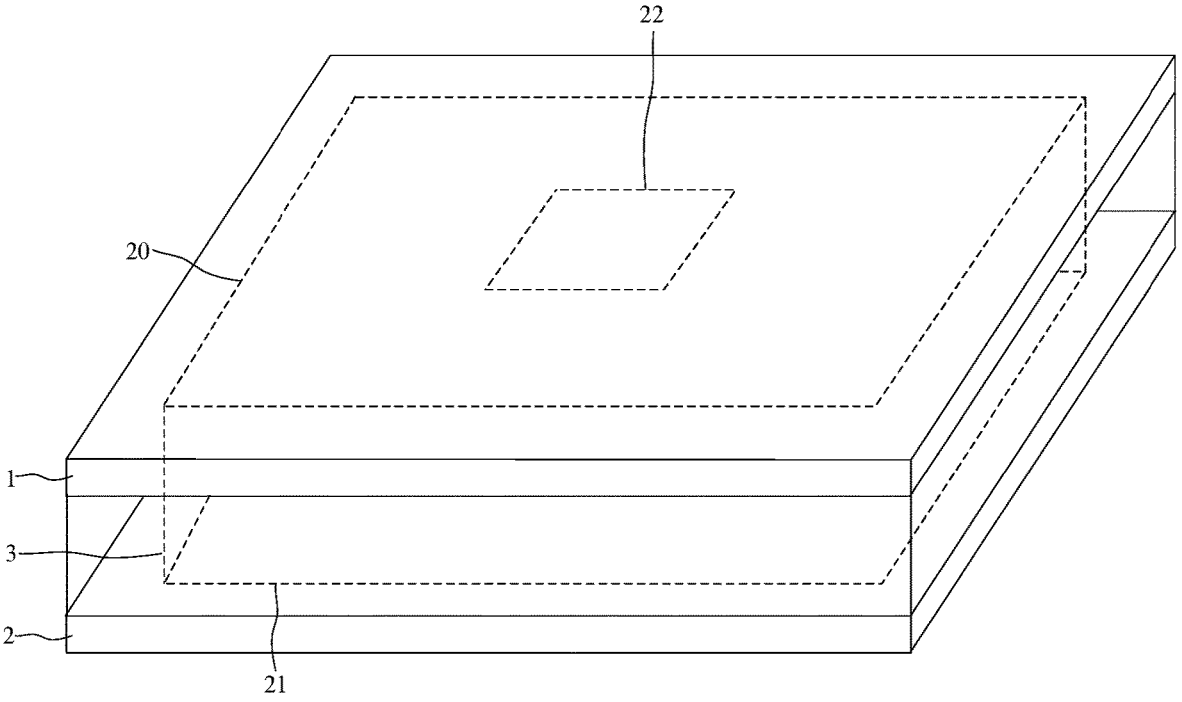
FIG. 4 is top view of a phased-array antenna according to another embodiment of the present disclosure.

FIG. 4 is top view of a phased-array antenna according to another embodiment of the present disclosure. In an embodiment, with reference to FIG. 2 in combination with FIG. 4, the first substrate 1 includes a first phase-shifting region 20, the second substrate 2 includes a second phase-shifting region 21, and the first phase-shifting region 20 and the second phase-shifting region 21 face towards each other to form the cavity 3. Multiple phase-shifting units 4 are evenly distributed in the cavity 3, and multiple power feeders 5 are located in a central region 22 of the first phase-shifting region 20. In this way, the radio-frequency signals corresponding to the multiple phase-shifting units 4 have similar transmission paths, and the radio-frequency signals have similar losses during transmission. Therefore, the radio-frequency signals radiated by the phase-shifting units 4 have similar intensities.

Figure 5:
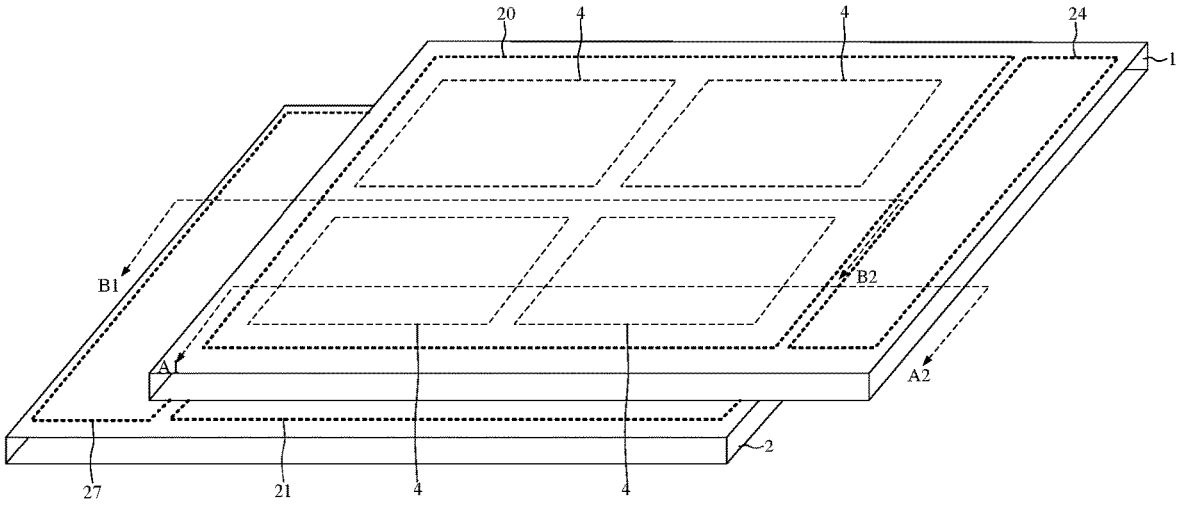
FIG. 5 is schematic diagram of a phased-array antenna according to another embodiment of the present disclosure.
Figure 6:
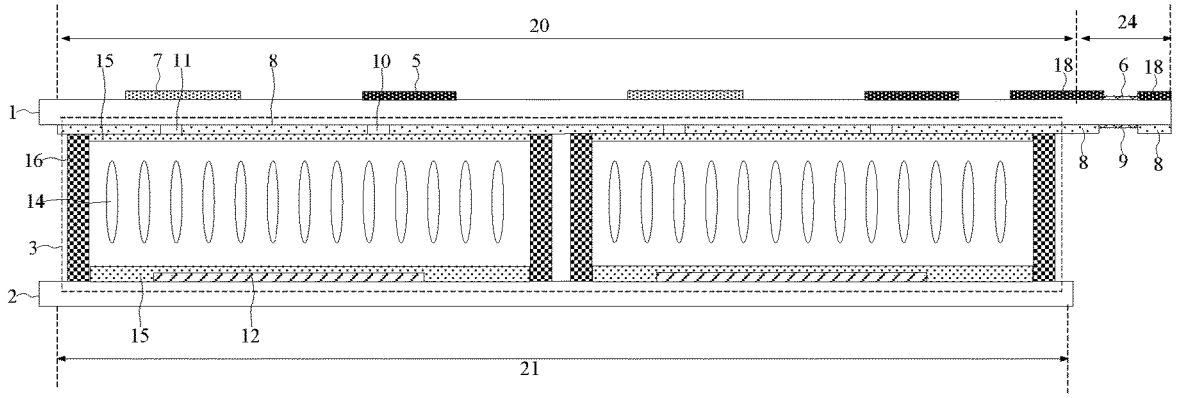
FIG. 6 is a cross-sectional view taken along A1-A2 line of the phased-array antenna shown in FIG. 5.
Figure 7:
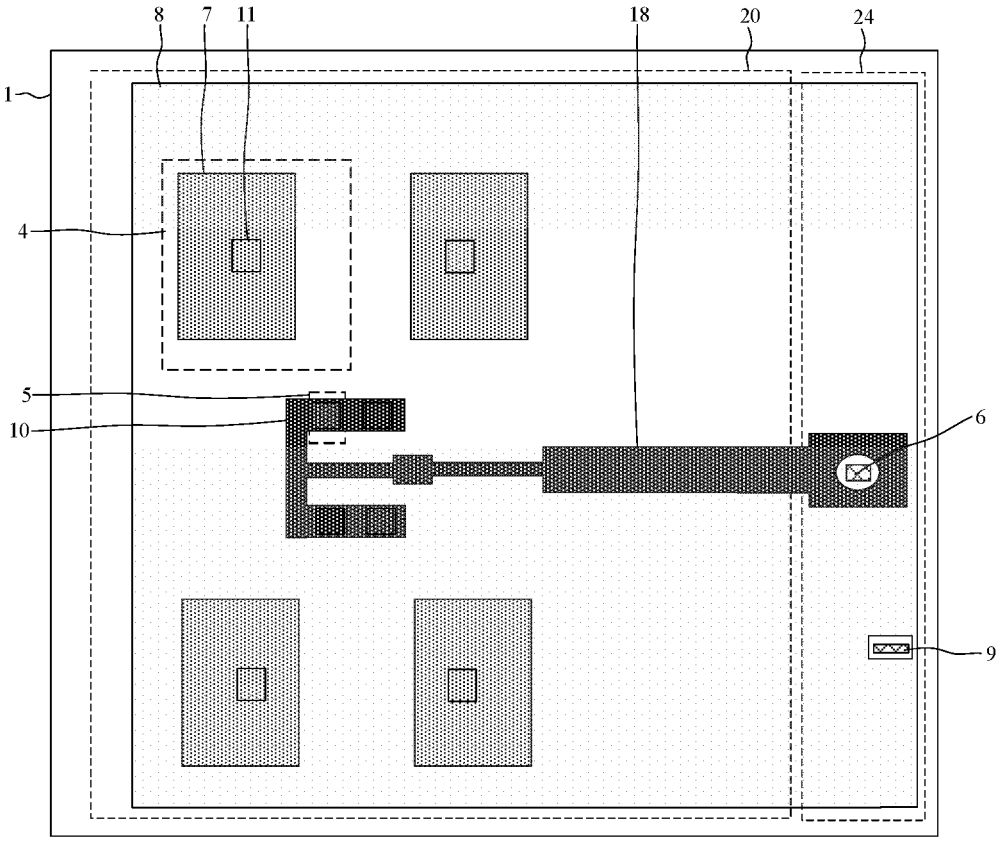
FIG. 7 is a top view of a first substrate of a phased-array antenna according to an embodiment of the present disclosure.

FIG. 5 is a schematic diagram of a phased-array antenna according to another embodiment of the present disclosure, FIG. 6 is a cross-sectional view taken along A1-A2 line of the phased-array antenna shown in FIG. 5, and FIG. 7 is a top view of a first substrate of a phased-array antenna according to an embodiment of the present disclosure. In an embodiment, as shown in FIG. 5 to FIG. 7, the first substrate 1 includes a first phase-shifting region 20 and a connecting region 24, the second substrate 2 includes a second phase-shifting region 21, and the first phase-shifting region 20 and the second phase-shifting region 21 face towards each other to form a cavity 3. In the direction perpendicular to the plane of the first substrate 1, an edge of the second substrate 2 and the connecting region 24 do not overlap with each other. The feeder 18 and the radio-frequency signal terminal 6 are connected to each other in the connecting region 24. For example, the feeder 18 and the radio-frequency signal terminal 6 are connected to each other through welding or metallic bonding in the connecting region 24, thereby forming a transmission path of the radio-frequency signal between the radio-frequency signal terminal 6, the feeder 18 and the power feeder 5. In this way, the radio-frequency signal can be transmitted to the power feeder 5.

In addition, the first substrate 1 includes the connecting region 24 independent from the first phase-shifting region 20, and the feeder 18 extends to the connecting region 24 after passing through the first phase-shifting region 20 so as to be connected to the radio-frequency signal terminal 6 in the connecting region 24. In this way, it is avoided that a process for connecting the feeder 18 and the radio-frequency signal terminal 6 affects a metal layer arranged in the first phase-shifting region 20. In an example, when the feeder 18 and the radio-frequency signal terminal 6 are connected to each other by a welding process, it can prevent solder from affecting the metal layer arranged in the first phase-shifting region 20, thereby improving reliability of signal transmission.

Figure 8:
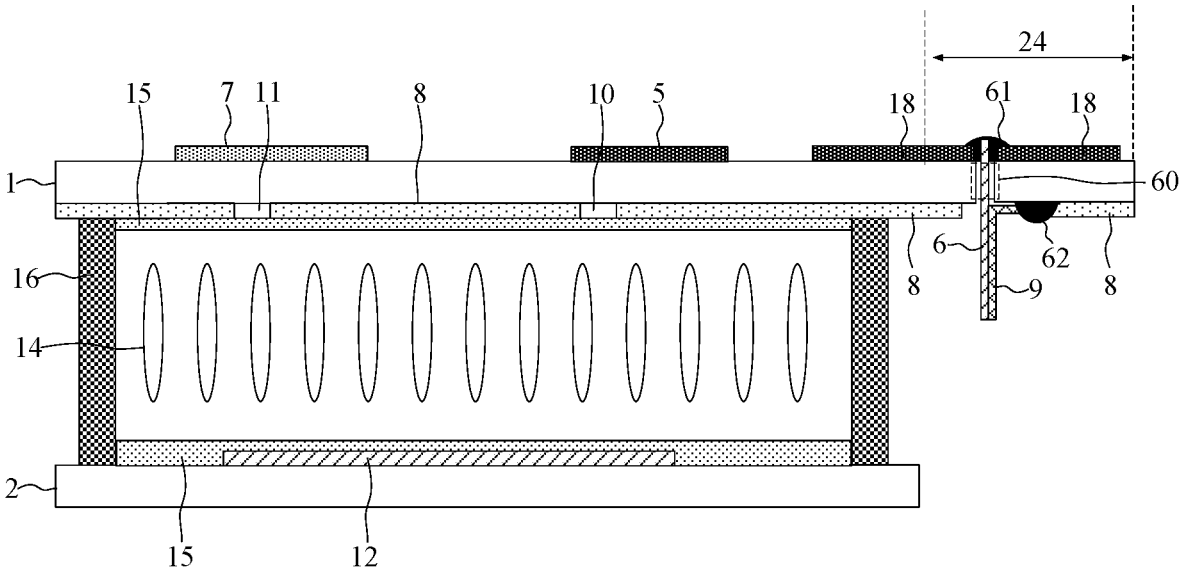
FIG. 8 is a schematic diagram illustrating an arrangement of a radio-frequency signal terminal according to an embodiment of the present disclosure.

FIG. 8 is a schematic diagram illustrating an arrangement of a radio-frequency signal terminal according to an embodiment of the present disclosure. As shown in FIG. 8, the first substrate 1 includes a through hole 60 in the connecting region 24, and the radio-frequency signal terminal 6 penetrates the through hole 60 to be connected to the feeder 18 through welding or metallic bonding on the surface of the first substrate 1 facing away from the second substrate 2. In an example, when the radio-frequency signal terminal 6 and the feeder 18 are welded to each other by a welding process, with further reference to FIG. 8, the radio-frequency signal terminal 6 and the feeder 18 are welded to each other through a welding spot 61.

In an embodiment, with further reference to FIG. 2, the transmission electrodes 12 of the multiple phase-shifting units 4 are electrically connected to multiple control signal lines 13 in one-to-one correspondence. With such configuration, the control signals received by phase-shifting units 4 are independent from each other. By individually controlling shifting of the phases of the radio-frequency signals by phase-shifting units 4, an accuracy of adjusting the main lobe direction of the beam formed by the phased-array antenna can be improved.

Figure 9:
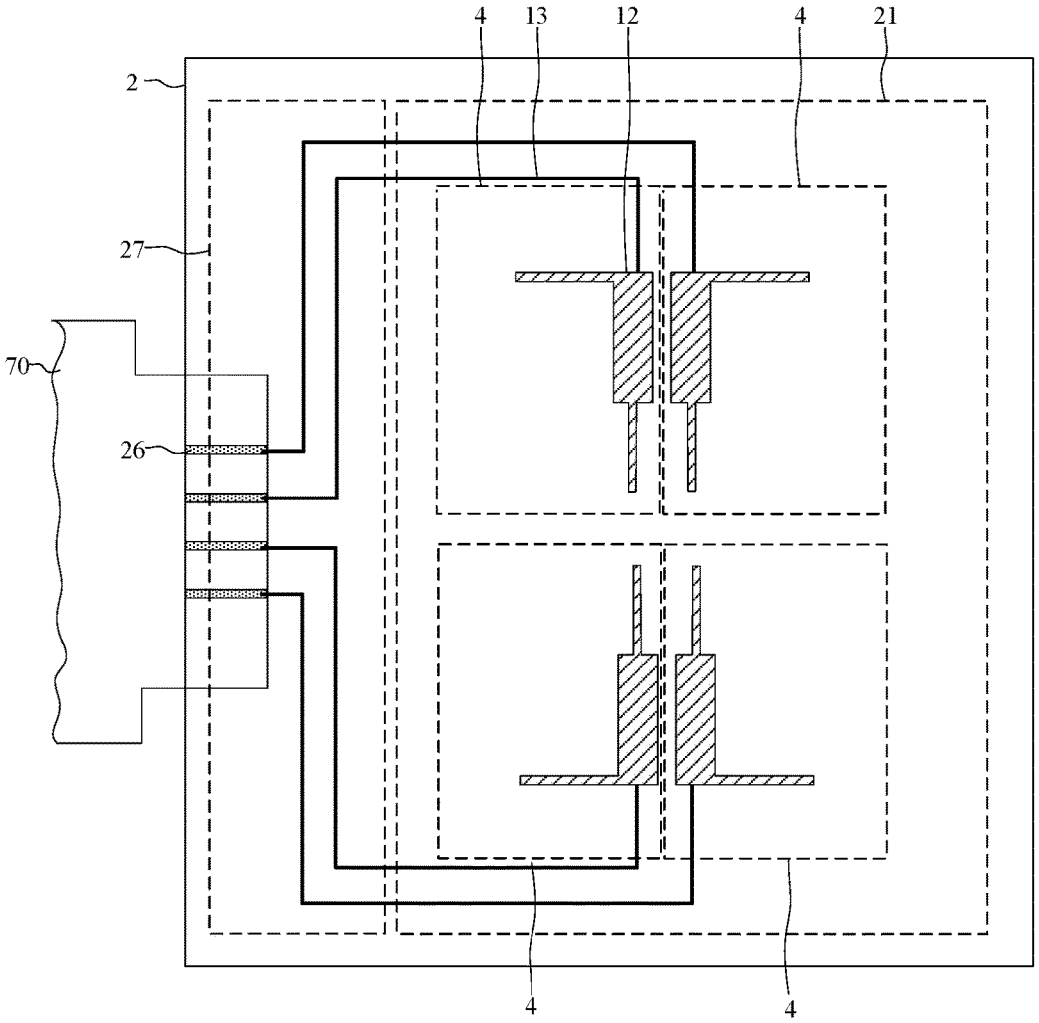
FIG. 9 is a top view of a second substrate of a phased-array antenna according to an embodiment of the present disclosure.

FIG. 9 is a top view of a second substrate of a phased-array antenna according to an embodiment of the present disclosure. In an embodiment, as shown in FIG. 9, the phased-array antenna further includes a flexible circuit board 70 on which multiple control signal terminals 26 are provided. The multiple control signal terminals 26 are electrically connected to the multiple control signal lines 13 in one-to-one correspondence, thereby forming a control signal transmission path between the control signal terminals 26 arranged on the flexible circuit board 70, the control signal line 13 and the transmission electrode 12. Therefore, it is ensured that the control signal can be transmitted to the transmission electrode 12.

Figure 10:
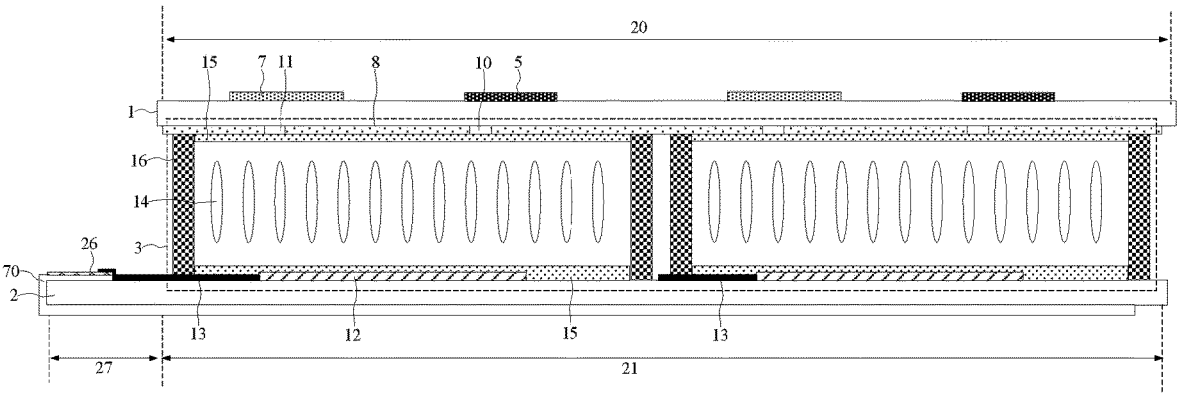
FIG. 10 is a cross-sectional view taken along B1-B2 line of the phased-array antenna shown in FIG. 5.

FIG. 10 is a cross-sectional view taken along B1-B2 line of the phased-array antenna shown in FIG. 5. Further, as shown in FIG. 10, the first substrate 1 includes a first phase-shifting region 20, the second substrate 2 includes a second phase-shifting region 21 and a bonding region 27, and the first phase-shifting region 20 and the second phase-shifting region 21 face towards each other to form the cavity 3. Moreover, in the direction perpendicular to a plane of the second substrate 2, the edge of the first substrate 1 and the bonding region 27 do not overlap with each other. The control signal terminal 26 and the control signal line 13 are electrically connected to each other in the bonding region 27. For example, in the bonding region 27, the control signal terminal 26 is electrically connected to the control signal line 13 by pressure welding of an anisotropic conductive film.

The second substrate 2 includes the bonding region 27 independent from the second phase-shifting region 20, and the control signal line 13 extends to the bonding region 27 after passing through the second phase-shifting region 21, so as to be electrically connected to the control signal terminal 26 in the bonding region 27. The bonding region 27 protrudes from the edge of the first substrate 1. In this way, after the first substrate 1 and the second substrate 2 are oppositely arranged to form a cell, when an end of the control signal line 13 in the bonding region 27 is connected to the control signal terminal 26 through pressure welding, the shielding of the first substrate 1 can be avoided, thereby improving operability of the pressure welding process.

Figure 11:
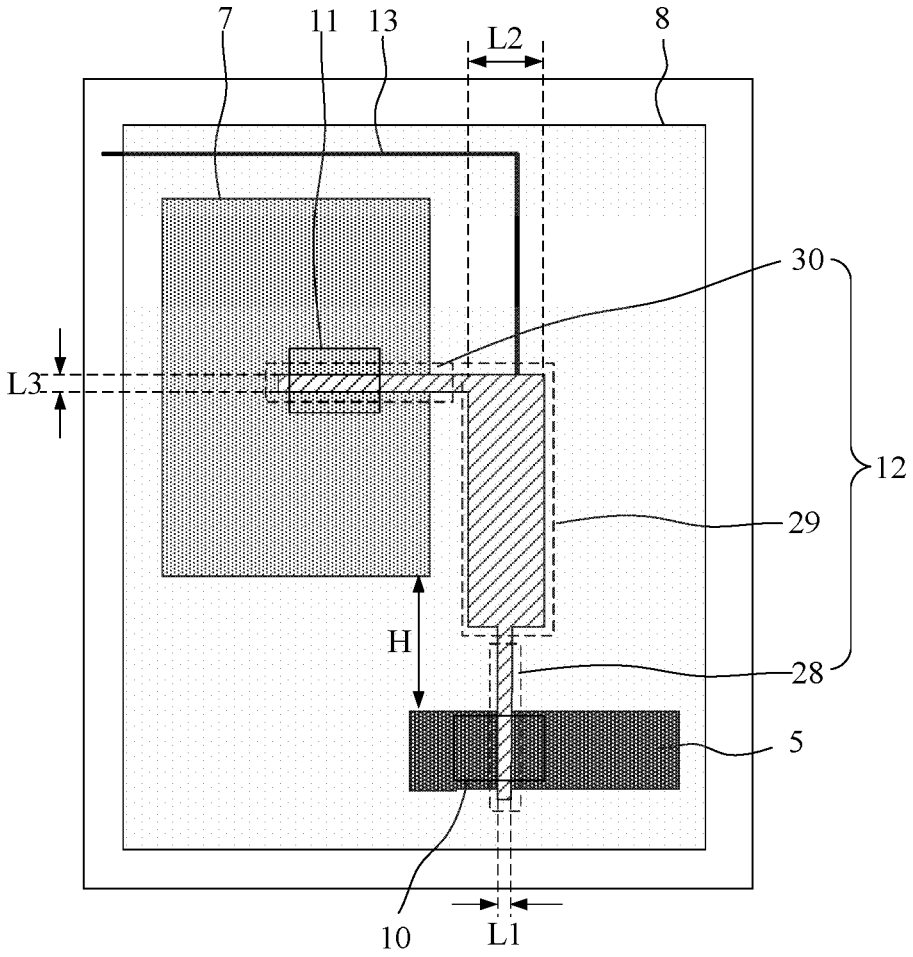
FIG. 11 is a top view of a single phase-shifting unit according to an embodiment of the present disclosure.

FIG. 11 is a top view of a single phase-shifting unit according to an embodiment of the present disclosure. In an embodiment, the transmission electrode 12 includes a first coupling portion 28, a signal transmission portion 29, and a second coupling portion 30. The signal transmission portion 29 is electrically connected to the first coupling portion 28 and the second coupling portion 30. In the direction perpendicular to the plane of the first substrate 1, the first coupling portion 28 overlaps with the first opening 10, and the second coupling portion 30 overlaps with the second opening 11. The first coupling portion 28 has a width of L1 in a direction perpendicular to a direction along which the first coupling portion extends, the signal transmission portion 29 has a width of L2 in a direction perpendicular to a direction along which the signal transmission portion extends, and the second coupling portion 30 has a width of L3 in a direction perpendicular to a direction along which the second coupling portion extends, where L2>L1 and L2>L3. By setting the width of the signal transmission part 29 to be relative large, an area of the signal transmission part 29 facing towards the ground electrode 8 can be increased. In this way, as much liquid crystal molecules 14 as possible can be in the electric field formed between the signal transmission part 29 and the ground electrode 8, thereby improving a deflection efficiency of the liquid crystal molecules 14, and thus improving the accuracy of shifting the phase of the radio-frequency signal.

Figure 12:
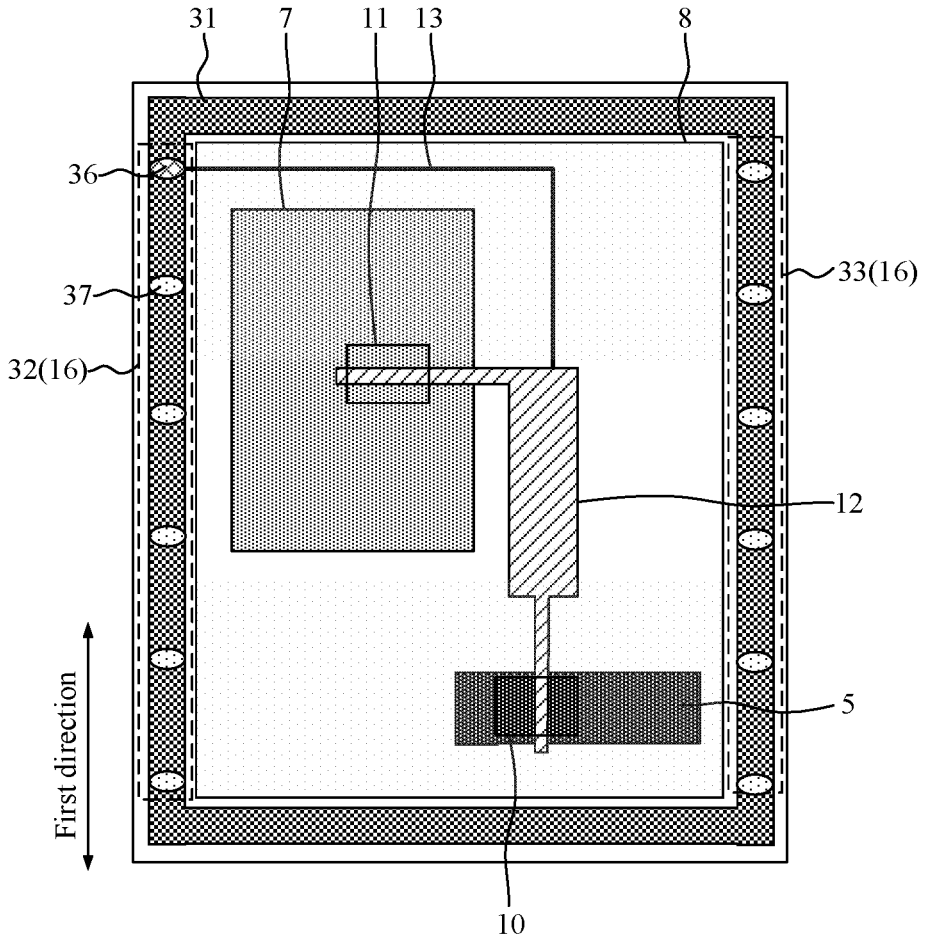
FIG. 12 is another top view of a single phase-shifting unit according to an embodiment of the present disclosure.
Figure 13:
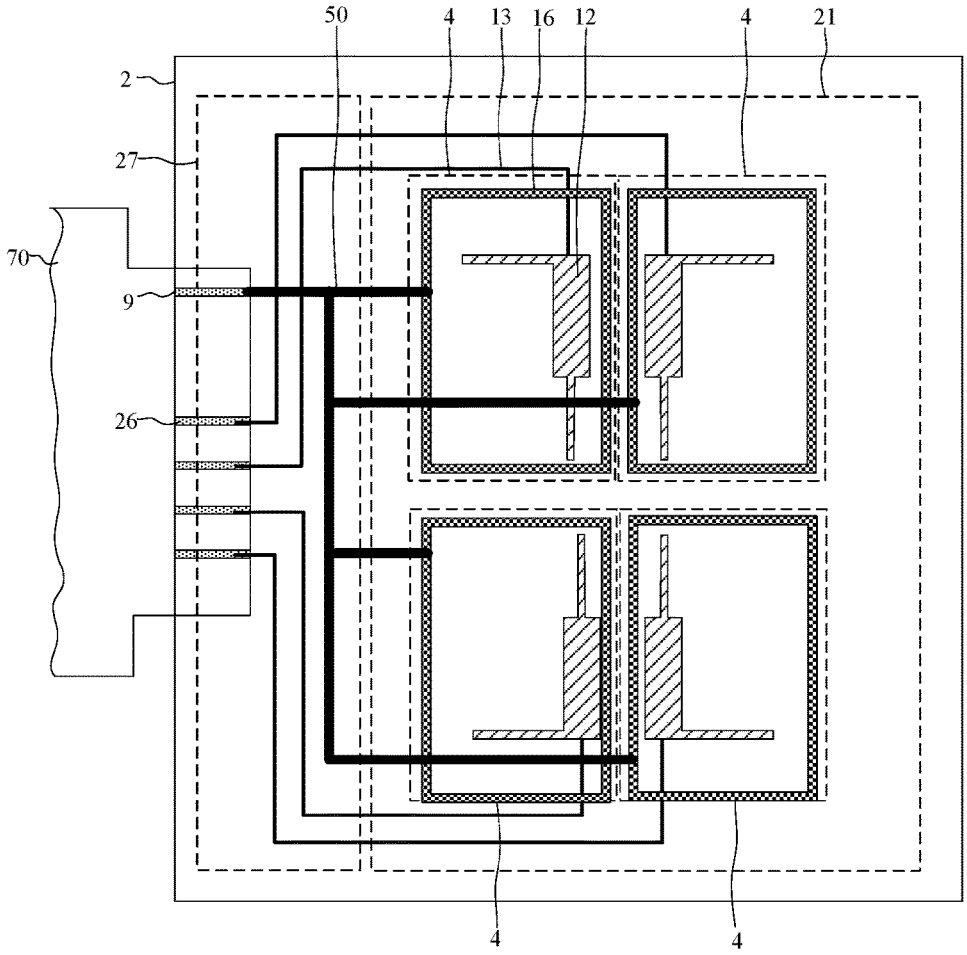
FIG. 13 is a top view of a second substrate according to another embodiment of the present disclosure.
Figure 14:
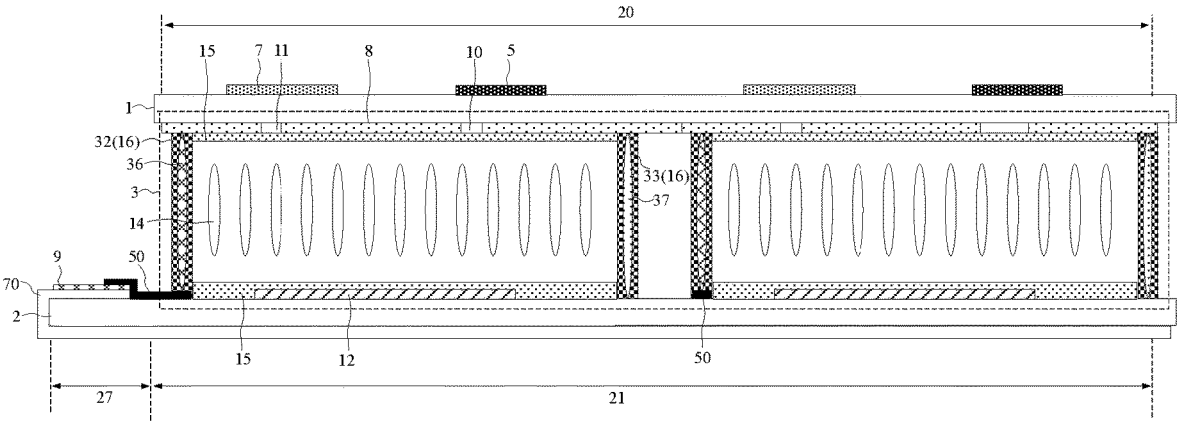
FIG. 14 is another cross-sectional view taken along B1-B2 line of the phased-array antenna shown in FIG. 5.

FIG. 12 is another top view of a single phase-shifting unit according to another embodiment of the present disclosure. FIG. 13 is a top view of a second substrate according to another embodiment of the present disclosure. FIG. 14 is another cross-sectional view taken along B1-B2 line of the phased-array antenna shown in FIG. 5. In an embodiment, as shown in FIG. 12 to FIG. 14, the phased-array antenna further includes a flexible circuit board 70 on which a ground signal terminal 9 is provided. The phase-shifting unit 4 further includes a sealant 16 located between the first substrate 1 and the second substrate 2. The sealant 16 includes a first encapsulation portion 32 and a second encapsulation portion 33 that each extend in a first direction. The first encapsulation portion 32 is located at a side of the second sub-encapsulation portion 33 close to the ground signal terminal 9. The first encapsulation portion 32 is provided with a metal support structure 36, and the metal support structure 36 is electrically connected to the ground electrode 8. The metal support structure 36 is further electrically connected to the ground signal terminal 9 through a connecting line 50. The metal support structure 36 can be a gold support ball.

It should be noted that, although it is merely illustrated in FIG. 14 that the connecting line 50 corresponding to the metal support structure 36 of one phase-shifting unit 4 is electrically connected to the ground signal terminal 9, it can be understood in combination with FIG. 13 that, the connecting line 50 corresponding to the metal support structure 36 of each of the phase-shifting units 4 is electrically connected to the ground signal terminal 9.

With the above configuration, the metal support structure 36 can be used to support a cell gap and improve uniformity of the cell gap, and the metal support structure 36 can also serve as a connection bridge between the ground signal terminal 9 and the ground electrode 8, forming a transmission path for a ground signal between the ground signal terminal 9 and the ground electrode 8. Therefore, it is ensured that the ground signal can be transmitted to the ground electrode 8.

In an embodiment, with further reference to FIG. 12 and FIG. 14, silicon support structures 37 are respectively provided in the first encapsulation portion 32 and the second encapsulation portion 33, thereby stably supporting the cell gap.

In an embodiment, with further reference to FIG. 13 and FIG. 14, the first substrate 1 includes a first phase-shifting region 20, the second substrate 2 includes a second phase-shifting region 21 and a bonding region 27, and the first phase-shifting region 20 and the second phase-shifting region 21 face towards each other to form the cavity 3. In the direction perpendicular to the plane of the second substrate 2, the edge of the first substrate 1 and the bonding region 27 do not overlap with each other. The connecting line 50 and the ground signal terminal 9 are electrically connected to each other in the bonding region 27. For example, the connecting line 50 and the ground signal terminal 9 can be pressure welded together through an anisotropic conductive film.

The bonding region 27 is arranged at a side of the second substrate 2, and the connecting line 50 extends from the second phase-shifting region 21 to the bonding region 27 and is then electrically connected to the ground signal terminal 9 in the bonding region 27. Moreover, the bonding region 27 protrudes from the edge of the first substrate 1. In this way, after the first substrate 1 and the second substrate 2 are oppositely arranged to form a cell, when an end of the bonding wire 50 in the bonding region 27 is pressure welded to the ground signal terminal 9, the shielding of the first substrate 1 can be avoided, thereby improving operability of the pressure welding process.

Figure 15:
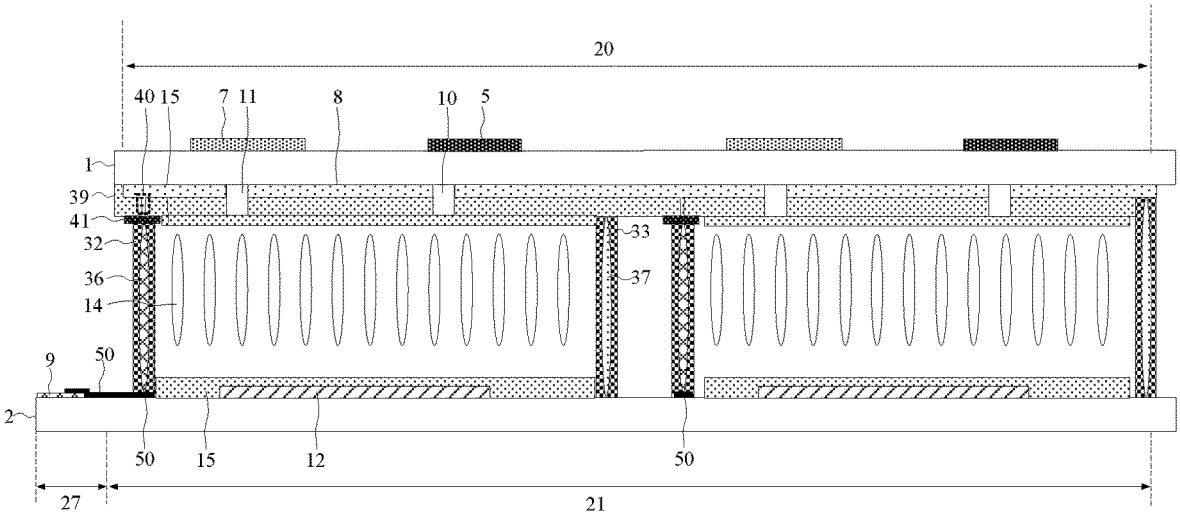
FIG. 15 is yet another cross-sectional view taken along B1-B2 line of the phased-array antenna shown in FIG. 5.

FIG. 15 is still cross-sectional view taken along B1-B2 line of the phased-array antenna shown in FIG. 5. In an embodiment. In an embodiment, as shown in FIG. 15, a first insulating layer 39 is provided at a side of the ground electrode 8 facing away from the first substrate 1, and the first insulating layer 39 is provided with a connecting via 40. An inert conductive layer 41 is provided at a side of the first insulating layer 39 facing away from the ground electrode 8, and the inert conductive layer 41 is electrically connected to ground electrode 8 through the connecting via 40. The inert conductive layer 41 is further electrically connected to metal support structure 36. The inert conductive layer 41 is a layer made of an inert conductive material that is not easily oxidized. The first insulating layer 39 covers the ground electrode 8, so as to avoid exposing the ground electrode 8. Therefore, a risk of the ground electrode 8 being oxidized and corroded can be decreased, thereby improving stability and reliability of operation of the phase-shifting unit 4. Moreover, by providing the inert conductive layer 41 electrically connected to the ground electrode 8, the ground signal transmitted by the metal support structure 36 can be transmitted to the ground electrode 8 through the inert conductive layer 41.

In an embodiment, in order to improve an anti-oxidation performance of the inert conductive layer 41, the inert conductive layer 41 can be made of an inert conductive material such as nickel, molybdenum, or indium tin oxide.

In an embodiment, with further reference to FIG. 15, parts of the first insulating layer 39 at the first opening 10 and the second opening 11 are hollow, so that when the radio-frequency signal is coupled to the transmission electrode 12 through the first opening 10 and is coupled to the radiator 7 through the second opening 11, loss of the radio-frequency signal can be decreased, thereby increasing the intensity of the radiated radio-frequency signal.

In an embodiment, with further reference to FIG. 6 and FIG. 7, the first substrate 1 includes a first phase-shifting region 20 and a connecting region 24, the second substrate 2 includes a second phase-shifting region 21, and the first phase-shifting region 20 and the second phase-shifting region 21 face towards each other to form the cavity 3. In the direction perpendicular to the plane of the first substrate 1, the edge of the second substrate 2 and the connecting region 24 do not overlap with each other. In the connecting region 24, the ground electrode 8 is electrically connected to the ground signal terminal 9. For example, in the connecting region 24, the ground electrode 8 is connected to the ground signal terminal 9 through welding or metallic bonding, thereby forming a ground signal transmission path between the ground signal terminal 9 and the ground electrode 8. Therefore, the ground signal can be transmitted to the ground electrode 8.

In addition, the first substrate 1 includes the connecting region 24 independent from the first phase-shifting region 20, and the ground electrode 8 extends to the connecting region 24 after passing through the first phase-shifting region 20 so as to be electrically connected to the ground signal terminal 9 in the connecting region 24. Moreover, the connecting region 24 protrudes from the edge of the second substrate 2. Therefore, after the first substrate 1 and the second substrate 2 are oppositely arranged to form a cell, when the ground electrode 8 is electrically connected to the ground signal terminal 9, shielding of the second substrate 2 can be avoided, thereby improving operability of the pressure welding process or the metallic bonding process.

In an embodiment, with further reference to FIG. 8, when the ground electrode 8 is connected to the ground signal terminal 9 by a pressure welding process, the ground signal terminal 9 is welded to the ground electrode 8 through a welding spot 62.

In addition, it should be noted that when the ground electrode 8 and the ground signal terminal 9 are connected to each other in a manner as shown in FIG. 12 to FIG. 14, the ground signal terminal 9 is electrically connected to the ground electrode 8 through the metal support structure 36 provided in the sealant 16. The metal support structure 36 has a small height, therefore, such a configuration can be applied to the phased-array antenna having a small cell gap, which is suitable for a portable communication device. When ground electrode 8 and the ground signal terminal 9 are connected to each other in a manner as shown in FIG. 6 and FIG. 7, the ground signal terminal 9 is electrically connected directly to the ground electrode 8 without using the metal support structure 36 as a connection bridge, therefore, such a configuration is not limited by the height of metal support structure 36, and thus can be applied to the phased-array antenna having a large cell gap, which is suitable for a large-scale communication device.

In an embodiment, with further reference to FIG. 2, the ground electrodes 8 of multiple phase-shifting units 4 are connected to each other. In this case, one ground signal terminal 9 can provide the ground signal to ground electrodes 8 of all phase-shifting units 4. Therefore, the number of the ground signal terminal 9 can be decreased, thereby further reducing the manufacturing cost of the phased-array antenna.

Figure 16:
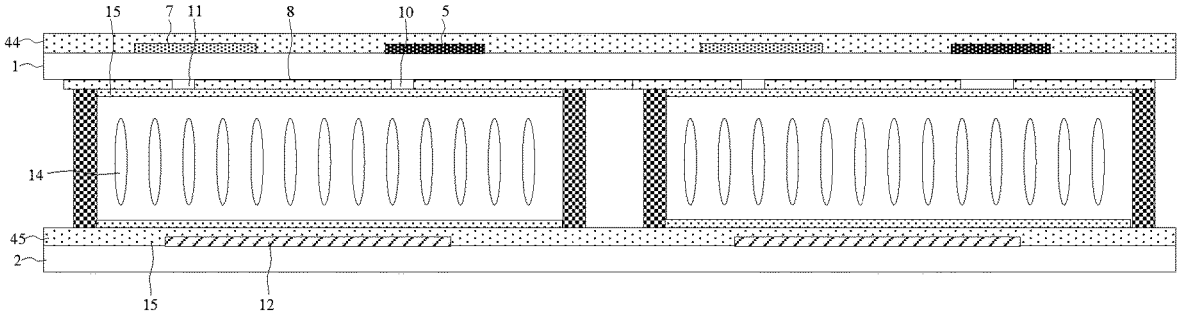
FIG. 16 is a cross-sectional view taken along C1-C2 line of the phased-array antenna shown in FIG. 1.

FIG. 16 is a cross-sectional view taken along C1-C2 line of the phased-array antenna shown in FIG. 1. In an embodiment, as shown in FIG. 16, a second insulating layer 44 is provided at a side of the power feeder 5 facing away from the first substrate 1 and at a side of the radiator 7 facing away from the first substrate 1, thereby avoiding exposure of the power feeder 5 and the radiator 7. Therefore, a risk of the power feeder 5 and the radiator 7 being oxidized and corroded can be decreased. A third insulating layer 45 is provided at the side of the transmission electrode 12 facing away from the second substrate 2, thereby avoiding exposure of the transmission electrode 12. Therefore, a risk of the transmission electrode 12 being oxidized or corroded can be avoided, thereby effectively improving stability and reliability of operation of the phase-shifting unit 4.

In an embodiment, with further reference to FIG. 11, a minimum distance between the power feeder 5 and the radiator 7 is H, where H≥5 μm. By setting the minimum value of H to 5 μm, an electrical connection between the power feeder 5 and the radiator 7 due to process error factors can be avoided. Therefore, the radio-frequency signal without phase shifting can be prevented from radiating directly through the radiator 7.

Figure 17:
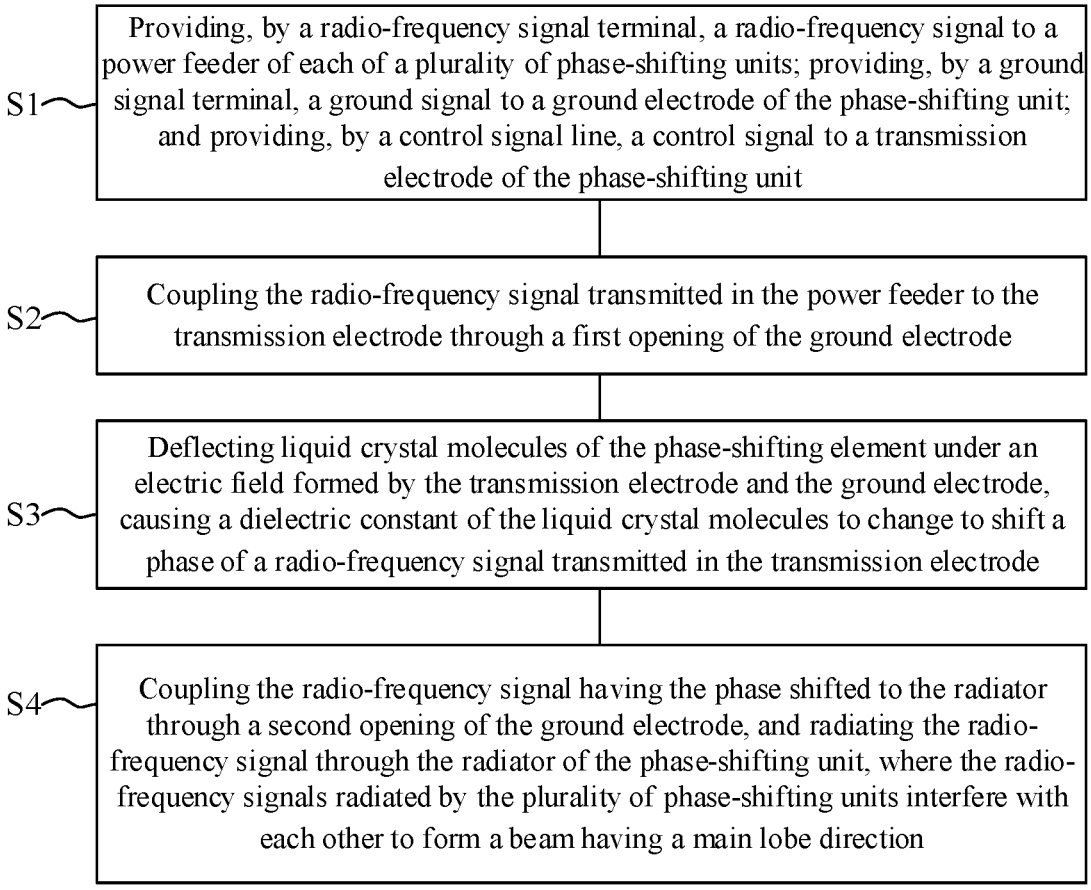
FIG. 17 is a flowchart of a method for controlling a phased-array antenna according to an embodiment of the present disclosure.

An embodiment of the present disclosure further provides a method for controlling a phased-array antenna, which is applied to the phased-array antenna described above. FIG. 17 is a flowchart of a method for controlling a phased-array antenna according to an embodiment of the present disclosure. In combination with FIG. 1 to FIG. 3, as shown in FIG. 17, the method includes following steps.

At step S1, the radio-frequency signal terminal 6 provides a radio-frequency signal to the power feeder 5 of the phase-shifting unit 4, the ground signal terminal 9 provides a ground signal to the ground electrode 8 of the phase-shifting unit 4, and the control signal line 13 provides a control signal to the transmission electrode 12 of the phase-shifting unit 4.

At step S2, the radio-frequency signal transmitted in the power feeder 5 is coupled to the transmission electrode 12 through the first opening 10 of the ground electrode 8.

At step S3, the liquid crystal molecules 14 in the phase-shifting unit 4 are deflected driven by an electric field formed between the transmission electrode 12 and the ground electrode 8, causing the dielectric constant of the liquid crystal molecules 14 to change, thereby shifting the phase of the radio-frequency signal transmitted in the transmission electrode 12.

At step S4, the radio-frequency signal having the phase shifted is coupled to the radiator 7 through the second opening 11 of the ground electrode 8, and is then radiated out via the radiator 7 of the phase-shifting unit 4, and the radio-frequency signals radiated by the multiple phase-shifting units 4 interfere with each other to form a beam having a main lobe direction.

For a single phase-shifting unit 4, the control signal line 13 provides different control signals to the transmission electrode 12, and the electric field formed by the transmission electrode 12 and the ground electrode 8 drives the liquid crystal molecules 14 to deflect, so that the liquid crystal molecules 14 can have different dielectric constants. Therefore, the phase-shifting unit 4 shifts the phase of the radio-frequency signal in different degrees. That is, in this embodiment of the present disclosure, the phase-shifting unit 4 is a phase-shifting unit 4 with a control signal having a variable voltage, and one phase-shifting unit 4 can radiate radio-frequency signals with multiple phases. In this way, by adjusting the phase of the radio-frequency signal radiated by the phase-shifting unit 4, when the radio-frequency signals radiated by the multiple phase-shifting units 4 interfere with each other, the resulting main lobe direction of the beam can be adjusted.

It can be seen that with the control method provided by the embodiment of the present disclosure, each phase-shifting unit 4 can radiate radiation signals having different phases under different control signals, thereby adjusting the finally formed main lobe direction of the beam formed by the phased-array antenna. Compared with the related art, the number of phase-shifting units 4 of the phased-array antenna is greatly decreased, that is, the number of phase shifters is greatly decreased, thereby effectively reducing the manufacturing cost of the phased-array antenna. In addition, the phased-array antenna provided by the embodiment of the present disclosure shifts the phase of the radio-frequency signal by the deflection of the liquid crystals 14, and due to a high manufacturing capacity of a liquid crystal molecule panel, the manufacturing cost of the phased-array antenna can be further decreased.

It should also be noted that the radiator 7 of the phase-shifting unit 4 can both radiate and receive signals. When the radiator 7 receives the radio-frequency signal, the liquid crystal molecules 14 of the phase-shifting unit 4 controls the phase of radio-frequency signal to be shifted. Then the radio-frequency signal having the phase shifted is transmitted to the radio-frequency signal terminal 6 through the power feeder 5, and is then radiated out via the radio-frequency signal terminal 6.

In an embodiment, in combination with FIG. 2, the phased-array antenna includes a feed electrode 17, and the feed electrode 17 includes a feeder 18 and the multiple power feeders 5. The multiple power feeders 5 correspond to the multiple phase-shifting units 4 in one-to-one correspondence, and the multiple power feeders 5 are electrically connected to radio-frequency signal terminal 6 through the feeder 18.

Based on the above, the process in which the radio-frequency signal terminal 6 provides the radio-frequency signal to the power feeder 5 of the phase-shifting unit 4 in the step S1 includes: the radio-frequency signal terminal 6 providing the radio-frequency signal to the radio line 18 of the feed electrode 17, and the radio-frequency signal being transmitted to each power feeder 5 through the feeder 18, so as to keep normal operation of each phase-shifting unit 4. With such configuration, only one radio-frequency signal terminal 6 is provided in the phased-array antenna, thereby further reducing the manufacturing cost of the phased-array antenna.

In an embodiment, in combination with FIG. 2, FIG. 9 and FIG. 10, the transmission electrodes 12 of the multiple phase-shifting units 4 are electrically connected to the multiple control signal lines 13 in one-to-one correspondence, and the phased-array antenna further includes a flexible circuit board 70 on which multiple control signal terminals 26, and the multiple control signal terminals 26 are electrically connected to the multiple control signal lines 13 in one-to-one correspondence.

Based on the above, the process in which the control signal line 13 provides the control signal to the transmission electrode 12 of the phase-shifting unit 4 in the step S1 includes: multiple control signal terminals 26 of the flexible circuit board 70 respectively providing a ground signal to corresponding control signal lines 13, and the control signal line 13 transmitting the ground signal to the corresponding transmission electrode 12. Based on this method, the control signals received by each phase-shifting unit 4 are independent from each other. By individually controlling shifting of the phases of the radio-frequency signals by phase-shifting units 4, an accuracy of adjusting the main lobe direction of the beam formed by the phased-array antenna can be improved.

In an embodiment, in combination with FIG. 12 to FIG. 14, the phased-array antenna further includes the flexible circuit board 70 on which the ground signal terminal 9 is provided. The phase-shifting unit 4 further includes the sealant 16, and the sealant 16 is arranged between the first substrate 1 and the second substrate 2. The sealant 16 includes the first encapsulation portion 32 and the second encapsulation portion 33 that each extend in the first direction. The first encapsulation portion 32 is located at a side of the second sub-encapsulation portion 33 close to the ground signal terminal 9. The first sub-package portion 32 is provided with the metal support structure 36, and the metal support structure 36 is electrically connected to the ground electrode 8. The metal support structure 36 is further electrically connected to the ground signal terminal 9 through the connecting line 50.

Based on the above, the process in which the ground signal terminal 9 provides the ground signal to the ground electrode 8 of the phase-shifting unit 4 includes: the ground signal terminal 9 of the flexible circuit board 70 transmitting the ground signal to the ground electrode 8 through the metal support structure 36. With such control, the metal support structure 36 can be used to support the cell gap and improve uniformity of the cell gap, and the metal support structure 36 can also serve as a connection bridge between the ground signal terminal 9 and the ground electrode 8, forming a transmission path for a ground signal between the ground signal terminal 9 and the ground electrode 8. Therefore, the ground signal can be transmitted to the ground electrode 8.

The above embodiments are merely exemplary embodiments of the present disclosure and are not intended to limit the present disclosure. Any modifications, equivalent substitutions and improvements made within the principle of the present disclosure shall fall into the protection scope of the present disclosure.

Finally, it should be noted that, the above-described embodiments are merely for illustrating the present disclosure but not intended to provide any limitation. Although the present disclosure has been described in detail with reference to the described embodiments, it should be understood by those skilled in the art that, it is still possible to modify the technical solutions described in the above embodiments or to equivalently replace some or all of the technical features therein, but these modifications or replacements do not cause the essence of corresponding technical solutions to depart from the scope of the present disclosure.

What is claimed is:

1. A phased-array antenna, comprising:

a first substrate;

a second substrate opposite to the first substrate; and a plurality of phase-shifting units received in a cavity formed between a part of the first substrate and a part of the second substrate that face towards each other, wherein each of the plurality of phase-shifting units comprises:

a power feeder provided on a surface of the first substrate facing away from the second substrate, wherein the power feeder is electrically connected to a radio-frequency signal terminal;

a radiator provided on the surface of the first substrate facing away from the second substrate, wherein the radiator is electrically insulated from the power feeder; and a ground electrode provided on a surface of the first substrate facing towards the second substrate, wherein the ground electrode is electrically connected to a ground signal terminal, wherein the ground electrode overlaps with both the power feeder and the radiator in a direction perpendicular to a plane of the first substrate, wherein the ground electrode comprises a first opening and a second opening, wherein the first opening is located in an area of the ground electrode where the ground electrode overlaps with the power feeder, and wherein the second opening is located in an area of the ground electrode where the ground electrode overlaps with the radiator;

a transmission electrode provided on a surface of the second substrate facing towards the first substrate, wherein the transmission electrode is electrically connected to one of a plurality of control signal lines; wherein the transmission electrode overlaps with the power feeder, the radiator and the ground electrode in the direction perpendicular to the plane of the first substrate, and the transmission electrode covers the first opening and the second opening in a direction perpendicular to a plane of the second substrate; and liquid crystal molecules provided between the first substrate and the second substrate.

2. The phased-array antenna according to claim 1, further comprising:

a feed electrode, wherein the feed electrode comprises a feeder and the plurality of power feeders of the plurality of phase-shifting units, the plurality of power feeders corresponds to the plurality of phase-shifting units in one-to-one correspondence, and the plurality of power feeders is electrically connected to the radio-frequency signal terminal through the feeder.

3. The phased-array antenna according to claim 2, wherein the first substrate comprises a first phase-shifting region, the second substrate comprises a second phase-shifting region, and the first phase-shifting region and the second phase-shifting region face towards each other to form the cavity; and wherein the plurality of phase-shifting units is evenly distributed in the cavity, and the plurality of power feeders of the plurality of phase-shifting units is located in a central region of the first phase-shifting region.

4. The phased-array antenna according to claim 2, wherein the first substrate comprises a first phase-shifting region and a connecting region, the second substrate comprises a second phase-shifting region, the first phase-shifting region and the second phase-shifting region face towards each other to form the cavity, and an edge of the second substrate and the connecting region do not overlap with each other in the direction perpendicular to the plane of the first substrate; and wherein the feeder is electrically connected to the radio-frequency signal terminal in the connecting region.

5. The phased-array antenna according to claim 1, wherein the plurality of transmission electrodes of the plurality of phase-shifting units is electrically connected to the plurality of control signal lines in one-to-one correspondence.

6. The phased-array antenna according to claim 5, further comprising:

a flexible circuit board on which a plurality of control signal terminals is provided, wherein the plurality of control signal terminals is electrically connected to the plurality of control signal lines in one-to-one correspondence.

7. The phased-array antenna according to claim 6, wherein the first substrate comprises a first phase-shifting region, the second substrate comprises a second phase-shifting region and a bonding region, the first phase-shifting region and the second phase-shifting region face towards each other to form the cavity, and an edge of the first substrate and the bonding region do not overlap with each other in the direction perpendicular to the plane of the second substrate; and wherein the plurality of control signal terminals is electrically connected to the plurality of control signal lines in the bonding region.

8. The phased-array antenna according to claim 1, wherein the transmission electrode comprises a first coupling portion, a signal transmission portion and a second coupling portion, and the signal transmission portion is electrically connected to the first coupling portion and the second coupling portion;

wherein in the direction perpendicular to the plane of the first substrate, the first coupling portion overlaps with the first opening, and the second coupling portion overlaps with the second opening; and wherein the first coupling portion has a width of L1 in a direction perpendicular to a direction along which the first coupling portion extends, the signal transmission portion has a width of L2 in a direction perpendicular to a direction along which the signal transmission portion extends, and the second coupling portion has a width of L3 in a direction perpendicular to a direction along which the second coupling portion extends, where L2>L1 and L2>L3.

9. The phased-array antenna according to claim 1, further comprising:

a flexible circuit board comprising the ground signal terminal, wherein each of the plurality of phase-shifting units further comprises a sealant arranged between the first substrate and the second substrate, the sealant comprises a first encapsulation portion and a second encapsulation portion that each extend in a first direction, and the first encapsulation portion is arranged at a side of the sealant close to the ground signal terminal; and wherein the first encapsulation portion is provided with a metal support structure therein, the metal support structure is electrically connected to the ground electrode; and the metal support structure is electrically connected to the ground signal terminal through a connecting line.

10. The phased-array antenna according to claim 9, wherein the first substrate comprises a first phase-shifting region, the second substrate comprises a second phase-shifting region and a bonding region, the first phase-shifting region and the second phase-shifting region face towards each other to form the cavity, and an edge of the first substrate and the bonding region do not overlap with each other in the direction perpendicular to the plane of the second substrate; and wherein the connecting line is connected to the ground signal terminal in the bonding region.

11. The phased-array antenna according to claim 9, further comprising:

a first insulating layer provided at a side of the ground electrode facing away from the first substrate, wherein the first insulating layer is provided with a connecting via; and an inert conductive layer provided at a side of the first insulating layer facing away from the ground electrode, wherein the inert conductive layer is electrically connected to the ground electrode through the connecting via, and is electrically connected to the metal support structure.

12. The phased-array antenna according to claim 11, wherein the inert conductive layer is made of nickel, molybdenum, or indium tin oxide.

13. The phased-array antenna according to claim 11, wherein parts of the first insulating layer respectively located at the first opening and the second opening are hollow.

14. The phased-array antenna according to claim 9, wherein the ground electrodes of the plurality of phase-shifting units are connected to each other.

15. The phased-array antenna according to claim 1, wherein the first substrate comprises a first phase-shifting region and a connecting region, the second substrate comprises a second phase-shifting region, the first phase-shifting region and the second phase-shifting region faces towards each other to form the cavity, and an edge of the second substrate and the connecting region do not overlap with each other in the direction perpendicular to the plane of the first substrate; and wherein the ground electrode is electrically connected to the ground signal terminal in the connecting region.

16. The phased-array antenna according to claim 15, wherein the ground electrodes of the plurality of phase-shifting units are connected to each other.

17. The phased-array antenna according to claim 1, further comprising:

a second insulating layer provided at a side of the power feeder facing away from the first substrate and at a side of the radiator facing away from the first substrate; and a third insulating layer provided at a side of the transmission electrode facing away from the second substrate.

18. The phased-array antenna according to claim 1, wherein a minimum distance between the power feeder and the radiator is H, where H≥5 μm.

19. A method for controlling the phased-array antenna according to claim 1, comprising, for each of the plurality of phase-shifting units:

providing, by the radio-frequency signal terminal, a radio-frequency signal to the power feeder of the phase-shifting unit, providing, by the ground signal terminal, a ground signal to the ground electrode of the phase-shifting unit, and providing, by one of the plurality of control signal lines, a control signal to the transmission electrode of the phase-shifting unit;

coupling the radio-frequency signal transmitted in the power feeder to the transmission electrode through the first opening of the ground electrode;

deflecting the liquid crystal molecules of the phase-shifting unit by an electric field formed by the transmission electrode and the ground electrode, in such a manner that a dielectric constant of the liquid crystal molecules is changed to shift a phase of a radio-frequency signal transmitted in the transmission electrode; and coupling the radio-frequency signal having the phase shifted to the radiator through the second opening of the ground electrode, and radiating the radio-frequency signal through the radiator of the phase-shifting unit, wherein radio-frequency signals radiated by the plurality of phase-shifting units interfere with each other to form the beam having the main lobe direction.

20. The method according to claim 19, wherein the phased-array antenna comprises a feed electrode, the feed electrode comprises a feeder and the plurality of power feeders of the plurality of phase-shifting units, the plurality of power feeders corresponds to the plurality of phase-shifting units in one-to-one correspondence, and the plurality of power feeders is electrically connected to the radio-frequency signal terminal through the feeder; and wherein said providing, by the radio-frequency signal terminal, the radio-frequency signal to the power feeder of the phase-shifting unit comprises:

providing, by the radio-frequency signal terminal, the radio-frequency signal to the feeder of the feed electrode; and transmitting the radio-frequency signal to each of the plurality of power feeders through the feeder.

21. The method according to claim 19, wherein the plurality of transmission electrodes of the plurality of phase-shifting units is electrically connected to the plurality of control signal lines in one-to-one correspondence, and the phased-array antenna further comprises a flexible circuit board comprising a plurality of control signal terminals, and the plurality of control signal terminals is electrically connected to the plurality of control signal lines in one-to-one correspondence; and wherein said providing, by the one of the plurality of control signal lines, the control signal to the transmission electrode of the phase-shifting unit comprises:

providing, by each of the plurality of control signal terminals of the flexible circuit board, a ground signal to one of the plurality of control signal lines corresponding to the control signal terminal; and transmitting, by the one of the plurality of control signal lines, the ground signal to the transmission electrode corresponding to the one of the plurality of control signal lines.

22. The method according to claim 19, wherein the phased-array antenna further comprises a flexible circuit board on which the ground signal terminal is provided;

wherein each of plurality of the phase-shifting units further comprises a sealant arranged between the first substrate and the second substrate, the sealant comprises a first encapsulation portion and a second encapsulation portion that each extend in a first direction, and the first encapsulation portion is arranged at a side of the sealant close to the ground signal terminal;

wherein the first encapsulation portion is provided with a metal support structure therein, the metal support structure is electrically connected to the ground electrode, and the metal support structure is electrically connected to the ground signal terminal through a connecting line; and wherein said providing, by the ground signal terminal, the ground signal to the ground electrode of the phase-shifting unit comprises: transmitting, by the ground signal terminal of the flexible circuit board, the ground signal to the ground electrode through the metal support structure.

* * * * *